United States Patent [19]

Kamezaki et al.

[11] 4,391,892

[45] Jul. 5, 1983

[54] MULTIPLE COPY ELECTROPHOTOGRAPHIC PROCESS USING DYE SENSITIZED ZNO

[75] Inventors: Yasushi Kamezaki, Sakai; Eiichi Inoue, Tokyo; Hitoshi Nishihama, Hirakata; Akira Fushida, Suita; Joji Matsumoto, Neyagawa, all of Japan

[73] Assignee: Mita Industrial Co., Ltd., Osaka, Japan

[21] Appl. No.: 321,102

[22] Filed: Nov. 13, 1981

Related U.S. Application Data

[63] Continuation-in-part of Ser. No. 174,503, Aug. 1, 1980, abandoned.

[30] Foreign Application Priority Data

Aug. 3, 1979 [JP] Japan ..... 54-98686

[51] Int. Cl.[3] ..... G03G 13/22; G03G 13/02

[52] U.S. Cl. ..... 430/126; 430/31; 430/89; 430/91; 430/902; 101/DIG. 13

[58] Field of Search ..... 430/31, 55, 902, 89, 430/91, 126

[56] References Cited

U.S. PATENT DOCUMENTS

| | | | |
|---|---|---|---|
| 3,412,242 | 11/1968 | Giaimo | 430/902 X |
| 3,519,420 | 7/1970 | Goffe | 430/31 X |
| 3,918,971 | 11/1975 | Zweig | 430/55 X |
| 4,063,945 | 12/1977 | Von Hoene et al. | 430/55 |
| 4,308,334 | 12/1981 | Kinoshita et al. | 430/89 |

FOREIGN PATENT DOCUMENTS

| | | | |
|---|---|---|---|
| 49-33795 | 10/1974 | Japan | 430/902 |

*Primary Examiner*—Roland E. Martin, Jr.
*Attorney, Agent, or Firm*—Sherman & Shalloway

[57] ABSTRACT

In an electrostatic photographic process comprising subjecting an electrostatic photographic photosensitive plate to the combination of negative charging, positive charging and imagewise exposure to form an electrostatic latent image of a positive polarity, said electrostatic photographic photosensitive plate having such charging characteristics that a photosensitive layer can be positively charged by sequential negative corona charging and positive corona charging and positive charging is rendered substantially impossible by irradiation with light, and then subjecting the so treated photosensitive plate to positive charging a predetermined number of times, whereby an electrostatic latent image is formed the predetermined number of times by imagewise exposure conducted once, if a zinc oxide-resin dispersion is used for the photosensitive layer of the photosensitive plate and predetermined amounts of a triphenylmethane basic dye and a silicone oil are incorporated in the photosensitive layer, the time required for negative charging can be shortened, and the charge potential at the time of positive charging can be increased and accumulation of the residual potential after irradiation with light can be reduced.

13 Claims, 4 Drawing Figures

MULTIPLE COPY ELECTROPHOTOGRAPHIC PROCESS USING DYE SENSITIZED ZNO

This application is a continuation-in-part application of the U.S. patent application Ser. No. 174,503 filed on Aug. 1, 1980, which has now been abandoned.

BACKGROUND OF THE INVENTION (1) Field of the Invention

The present invention relates to an improvement in an electrostatic photographic process in which ordinary electrostatic photographic reproduction and electrostatic photographic printing including the step of imagewise exposure conducted once and the charging step conducted many times can be carried out repeatedly by using a single photosensitive material.

(2) Description of the Prior Art

As is well-known, according to the electrostatic photographic process, copies and prints are prepared by forming an electrostatic latent image by the combination of the step of charging a photoconductive photosensitive layer with charges of a certain polarity and the steps of subjecting the photoconductive photosensitive material to imagewise exposure, developing the formed electrostatic latent image with a toner such as a detecting powder, transferring the toner image to a copy sheet and, if necessary, fixing the transferred toner image.

In this electrostatic photographic process, there is known a method in which many copies or prints are prepared by conducting the imagewise exposure step only once.

The oldest technique of this method is disclosed in the specification of U.S. Pat. No. 2,812,709. According to this method, a toner image formed on a photosensitive layer by conducting the developing operation once is transferred in a divided manner onto copy sheets to obtain many copies (transfer repetition method). In this method, since the amount of the toner that can be applied by one developing operation is limited, the number of obtainable copies should naturally be limited, and if it is tried to obtain many copies beyond this limit, reduction of the image density and contrast cannot be avoided.

There has already been proposed a method in which development and transfer are repeated on one electrostatic latent image to obtain many copies or prints. For example, Japanese Patent Publication No. 30233/69 discloses a method in which a toner image is brought into intimate contact with a transfer sheet by an electrically conductive roller, a transfer voltage is applied between the toner image and the transfer sheet to transfer a part of the toner of the toner image to be transfer sheet and repeating the development and transfer while gradually increasing the transfer voltage to obtain many copies. Furthermore, Japanese Patent Publication No. 5056/75 discloses a method in which a latent image formed on a photosensitive layer is developed with a toner of the same polarity as that of the latent image, the formed toner image is brought into intimate contact with an insulating transfer sheet by an electrically conductive roller to transfer the toner image to the transfer sheet and this developing and transferring operation is repeated to obtain many copies. In these known methods, however, since a once formed electrostatic latent image should be subjected to the development repeatedly, there is involved the requirement that cannot industrially be satisfied, that is, the requirement that the development and transfer should be repeated without disturbance of the electrostatic latent images. Furthermore, in the former method, a troublesome operation of gradually increasing the transfer voltage should be carried out, and the latter method is defective in that a poorly printed area is formed in a broad black region and the image quality is insufficient, because the repelling development is carried out.

There also is known a method in which many copies are obtained by repeating charging, development and transfer after imagewise exposure conducted once, while utilizing the photomemory effect of a photoconductive photosensitive layer (the phenomenon in which the exposed area retains the electric conductivity even after the exposure). For example, photographic methods of this type are disclosed in R. M. Schaffert, "Electrophotography" (published in 1975 by Focal Press), D. J. Williams, Tappi, 56, No. 6 (1973), Eiichi Inoue, Lecture published on Nov. 11, 1971 at the 28th Meeting of the Japanese Society of Electrophotography and Japanese Patent Application Laid-Open Specification No. 117635/76.

In these methods utilizing the photomemory effect of a photoconductive photosensitive layer, no particular disadvantage is brought about when this photosensitive layer is used for electrostatic printing alone. However, in order to erase the photomemory effect of the photosensitive layer, it is necessary to conduct a troublesome operation of allowing the photosensitive layer to stand in the dark for a long time or heating the photosensitive layer by infrared rays or the like. When a photosensitive layer having such photomemory effect is applied to the ordinary electrostatic photographic reproduction process in which from many originals, corresponding copies are prepared, the copying speed is drastically reduced and this photosensitive layer is not suitable for commercial reproduction or printing.

U.S. Pat. No. 3,918,971 to Zweig discloses a photographic copying process in which a photoconductive insulating layer coated on a substrate is rendered uniformly non-conductive to make multiple copies by negatively charging the surface, the layer is next sensitized by positively charging the surface after which it is imaged and conventionally developed with electrostatically attractable material, the electrostatically attractable material is then conventionally transferred in offset fashion onto a copy sheet, surface charge is lost and the latent image is thereby degraded during the process of toning the imaged photoconductive surface and transferring the toner to the copy sheet, and repetitive copies can then be made from the latent image by passing a uniform positive charge over the layer to rejuvenate the latent image and repeating the developing and transferring steps each time.

In the photographic copying process of this type, in order to increase the copying speed, it is desirable to shorten the time for negative charging as much as possible. Moreover, in order to increase the image density, it is necessary to elevate the potential at the time of positive charging. Furthermore, in order to reduce the fog density, it is important that the residual potential in the light-exposed area should be reduced and this residual potential should always be controlled to a low level even when the steps of positive charging, development and transfer are repeated.

SUMMARY OF THE INVENTION

The present invention relates to an improvement in the above-mentioned known photographic copying process as disclosed in U.S. Pat. No. 3,918,971 to Zweig. According to the present invention, the time required for negative charging can be shortened as much as possible and the saturation voltage at the time of positive charging can be increased. Furthermore, even after the cycle of positive charging-light exposure is repeated, accumulation of the residual potential can be prevented and the residual potential can be controlled to a certain low level.

In accordance with the present invention, there is provided an improvement in an electrostatic photographic process comprising subjecting an electrostatic photographic photosensitive plate to the combination of negative charging, positive charging and imagewise exposure to form an electrostatic latent image of a positive polarity, said electrostatic photographic photosensitive plate having such charging characteristics that a photosensitive layer can be positively charged by sequential negative corona charging and positive corona charging and positive charging is rendered substantially impossible by irradiation with light, and then subjecting the so treated photosensitive plate to positive charging a predetermined number of times, whereby an electrostatic latent image is formed the predetermined number of times by imagewise exposure conducted once, said improvement characterized in that said electrostatic photographic photosensitive plate comprises an electrically conductive substrate having a surface with a work function smaller than the work function of ZnO and being selected from the group consisting of aluminum, zinc, cadmium, lead, indium and tin and a photoconductive zinc oxide-resin binder dispersion photosensitive layer comprising a dispersion of photoconductive zinc oxide having a particle size not larger than 0.53 $\mu$m and a BET specific surface area of at least 4.6 $m^2/g$ and a resin binder having a volume resistivity of at least $10^{14}$ $\Omega$-cm, in which the resin binder/zinc oxide mixing weight ratio is smaller than 5/10, said photoconductive layer further comprising a triphenylmethane basic dyestuff represented by the following formula:

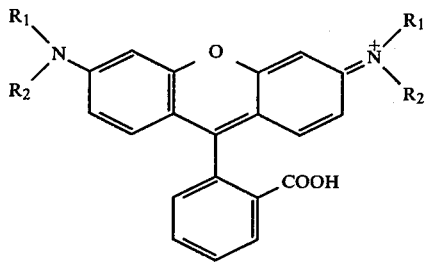

wherein $R_1$ represents a lower alkyl group and $R_2$ represents a hydrogen atom or a lower alkyl group, in an amount of about 2 to about 3 mg per 10 g of zinc oxide and a silicone oil in an amount of about 0.02 to about 0.04 mg per 10 g of zinc oxide, and said photosensitive plate has a memory resistance (R), defined by the following formula, of at least 90%:

$$R = \frac{EL}{ED} \times 100$$

wherein ED stands for the saturation charge voltage (V) of the photosensitive layer observed when the photosensitive layer is stored in a dark place for 3 hours and is then subjected to corona discharge at a voltage of −6 KV and EL stands for the saturation charge voltage (V) of the photosensitive layer observed when the photosensitive layer is irradiated with light in a light quantity of $3\times10^5$ lux·sec, stored in a dark place for 1 minute and then subjected to corona discharge under the same conditions as described above.

DETAILED DESCRIPTION OF THE PREFERRED EMBODIMENTS

Figure 1:
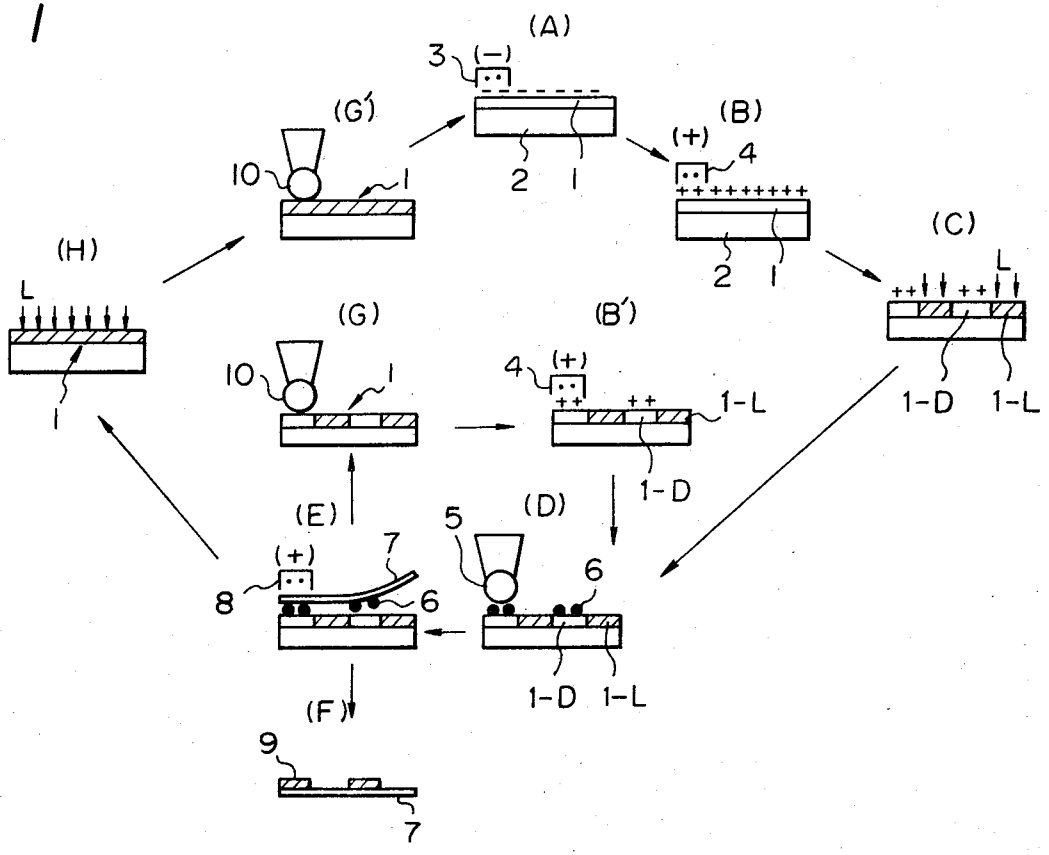
FIG. 1 is a diagram illustrating the steps of the photographic process according to the present invention.

An electrostatic photographic photosensitive layer composed of a specific photoconductive zinc oxide-resin binder dispersion having a low photomemory effect, that is, a high memory resistance defined by the above formula (1), has such charging characteristics that (i) negative charging is always possible, (ii) the photosensitive layer can be positively charged by negative corona discharge followed by positive corona discharge, and (iii) positive charging is rendered substantially impossible by light exposure. The present invention applies the principle of such specific charging characteristics to the electrostatic photographic process.

It is well-known that when a zinc oxide photosensitive layer is subjected to negative corona discharge, by injection and permeation of negative ions into the photosensitive layer by corona, the contact state not allowing supply of electrons to zinc oxide, that is, the so-called blocking contact, is formed in the interface between zinc oxide particles and the binder. It also is well-known that when the zinc oxide photosensitive layer is subjected to negative corona discharge and then to positive corona discharge, the photosensitive layer can effectively be positively charged (see, for example, the specification of U.S. Pat. No. 3,412,242).

On the other hand, when a zinc oxide photosensitive layer formed on an electrically conductive substrate composed of Al or the like is irradiated with light, isolation of oxygen ions (negative ions) adsorbed on the surface of zinc oxide is caused, with the result that the blocking effect owing to oxygen ions present among zinc oxide particles and between zinc oxide particles and the electrically conductive substrate is caused to disappear. Therefore, the ohmic contact state is produced among zinc oxide particles and between zinc oxide particles and the electrically conductive substrate. Even if the photosensitive material is subjected to positive corona discharge in this state, charging is impossible because of neutralization of positive ions by electrons. On the other hand, in the dark region, the blocking contact is maintained in the above-mentioned interface, and therefore, the blocking contact is maintained also between zinc oxide particles and the electrically conductive substrate. Accordingly, in the dark region, neutralization of positive ions is not caused and positive charging is possible.

In the present invention, the change of the barrier height of the interface between zinc oxide and the binder, which is caused by adsorption of oxygen ions by zinc oxide particles or isolation of oxygen ions from zinc oxide particles, is utilized for formation of a pattern from the charged area and the non-charged area at the positive corona discharge. Accordingly, the electrostatic photographic process of the present invention should definitely be distinguished from the conventional process utilizing the photomemory effect.

More specifically, in case of a photosensitive layer having a photomemory effect, that is used in the known process, the irradiated region loses the inherent property of zinc oxide, that is, the property of increasing the electric resistance thereof, because of substantially irreversible photochemical reaction. In contrast, the photosensitive layer used in the present invention can always be negatively charged. Namely, the photosensitive layer used in the present invention is kept unchargeable selectively to positive charges while maintaining the above-mentioned inherent property of zinc oxide.

In the present invention, in order to facilitate adsorption or desorption of oxygen ions by negative charging or irradiation with actinic rays and to form a photoconductive photosensitive layer having the above-mentioned charging characteristics, some requirements concerning the kinds of photoconductive zinc oxide and binder to be used, the mixing ratio of both the components and the material of the surface of the substrate supporting a photoconductive zinc oxide layer should be satisfied.

First of all, in order to increase the amount adsorbed of oxygen ions and also increase the height of the barrier formed by oxygen ions so as to increase the difference of this barrier height from the barrier height attained by isolation of oxygen ions by actinic rays, it is very important to increase the number of gas-adsorbing sites on the surface of photoconductive zinc oxide. Furthermore, in the present invention, it is very important that as described hereinafter, the binder resin should be used in a larger amount than in the conventional photoconductive layer for negative charging. From the viewpoints of these requirements, in the present invention, it is preferred that the photoconductive zinc oxide used be as fine as possible. More specifically, it is preferred that the particle size (the particle size referred to in the instant specification is one determined according to the air permeation method) be smaller than 1 $\mu$m, especially smaller than 0.5 $\mu$m and that the BET specific surface area be larger than 3 $m^2/g$, especially larger than 5 $m^2/g$. When photoconductive zinc oxide having a particle size larger than 1 $\mu$m or a BET specific surface area smaller than 3 $m^2/g$ is used, it is difficult to sufficiently increase the height of the interface barrier formed by negative charging and also is difficult to maintain a sufficient high potential of positive charging.

The binder to be used in the present invention should have a volume resistivity of at least $10^{14}$ $\Omega$-cm. In case of negative charging, the resistance of zinc oxide per se can be increased by the operation, and therefore, a binder having a lower volume resistivity may be used. However, in case of positive charging, attainment of this effect of increasing the resistance of zinc oxide cannot be expected. Therefore, in order to maintain charges in case of positive charging, it is important that the above requirement of the volume resistivity should be satisfied. Since positive charging according to the present invention depends greatly on negative charging conducted in advance, even if binders having the same resistivity are employed, it sometimes happens that differences are brought about in negative charging characteristics owing to the difference in the affinity with zinc oxide. Accordingly, use of a binder exhibiting good charging characteristics at the negative charging is preferred. From the viewpoint of the photosensitivity, it is preferred to use a binder having a high transparency. As examples of the resin binder satisfying these requirements, there can be mentioned a silicone resin, a styrene resin, an acrylic resin or a mixture thereof. Of course, resins that can be used in the present invention are not limited to those mentioned above. In short, any of resin binders having the above-mentioned volume resistivity and good negative charging characteristics can be used in the present invention.

It is preferred that the resin binder/zinc oxide mixing weight ratio be in the range of from 2/10 to 4/10, especially from 2.5 to 10 to 3.5/10. If the amount of the resin is too small and below the above range, decay of the potential is gradually caused even in the dark area (non-exposed area) while positive charging is repeated. When the amount of the resin is too large and above the above range, rising of the potential is delayed at the charging step and the residual potential in the exposed area tends to increase and accumulate while positive charging is repeated.

In the present invention, it is important that a triphenylmethane basic dyestuff defined by the above general formula should be contained in the photosensitive layer in an amount of about 2 to about 3 mg per 10 g of ZnO and a silicone oil should also be contained in the photosensitive layer in an amount of about 0.02 to about 0.04 mg per 10 g of ZnO.

Silicone oils are widely used as leveling agents for photosensitive layers. If a silicone oil is used in the above-mentioned specific amount according to the present invention, there can be attained excellent effects that cannot be expected from the effects attained by conventional silicone oil leveling agents. More specifically, the time required for negative charging can be shortened and the potential at positive charging can prominently be improved. If the amount of the silicone oil is too small and below the above-mentioned range, the above effects cannot be attained and if the amount of the silicone oil is too large and exceeds the above range, the residual potential in the light-exposed area at the time of positive charging-light exposure is increased and fogging is caused.

A triphenylmethane basic dyestuff is widely used for sensitization of a zinc oxide photosensitive layer. If a dyestuff of this type is used in the above-mentioned specific amount according to the present invention, the residual potential in the light-exposed area at the time of positive charging-light exposure can be controlled to a very low level, and even if this cycle of positive charging and light exposure is repeated, accumulation of the residual potential can be prevented. As is apparent from Examples given hereinafter, the amount of the dyestuff is very critical. If the amount of the dyestuff is too large and exceeds the above-mentioned range, the saturation charge voltage is reduced, and if the amount of the dyestuff is too small and below the above-mentioned range, the intended effects cannot be attained and fogging is readily caused.

A most preferred example of the triphenylmethane basic dyestuff represented by the above general formula is C.I. Basic Violet 10 (Rhodamine B), and C.I. Basic Red 8 (Rhodamine G) comes next.

The silicone oil that is used in the present invention consists of a linear polydimethylsiloxane, and a silicone oil having a viscosity of 5 to 50 cSt, especially about 10 cSt, as measured at 25° C. is preferably used.

Any of substrates having a surface capable of performing sufficient injection of electrons into the photosensitive layer can be used as the electrically conductive substrate to which the zinc oxide-binder composition is coated in the present invention. It is preferred that the surface of the substrate be composed of a material having a work function smaller than the work function (about 4.3 eV) of ZnO. Aluminum is most preferred, and the surface composed of a metal such as Zn, Cd, Pb, In or Sn may also be used. Such metal material may be used in the form of a sheet or foil of a single metal. Furthermore, such metal may be deposited on other metal such as iron or copper by plating. If desired, a so-called undercoat layer may be formed between the electrically conductive substrate and the photosensitive layer so as to improve the adhesion and increase the charging potential. However, formation of an undercoat layer having such a thickness as inhibiting injection of electrons should be avoided, and ordinarily, the thickness of the undercoat layer is limited to less than 1 $\mu$m.

The thickness of the zinc oxide-binder composition layer has a relation to the charging potential. More specifically, the charging potential is elevated with increase of the thickness. In order to reduce the potential of the positively charged zinc oxide photosensitive layer by irradiation of actinic rays, it is necessary to cause the rays to arrive at a considerably deep portion of the photosensitive portion, that is, a portion close to the support, because zinc oxide has an n-type photoconductive mechanism. Accordingly, the photosensitivity at the positive charging depends greatly on the thickness of the photosensitive layer, and the photosensitivity is reduced with increase of the thickness.

From the foregoing, it will readily be understood that the thickness of the photosensitive layer may be determined in view of both the necessary charging potential and the required photosensitivity, and the thickness of the photosensitive layer is by no means limited within a specific range.

However, it is ordinarily preferred that the thickness of the zinc oxide-binder composition layer be 3 to 50$\mu$, especially 10 to 30$\mu$, as measured in the dry state.

The photosensitive layer that is used in the present invention can easily be prepared according to the known procedures, so far as the above requirements are satisfied.

Figure 2:
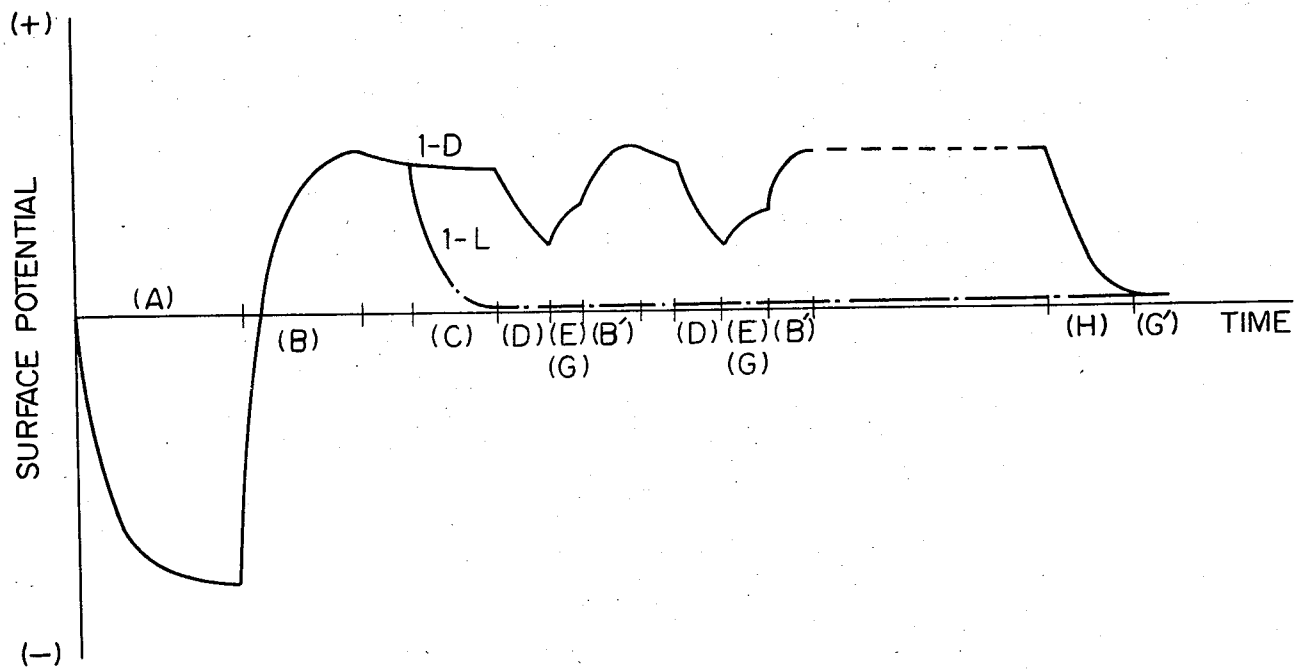
FIG. 2 is a graph illustrating the surface potentials of the photosensitive layer at the steps shown in FIG. 1.

Referring to FIGS. 1 and 2 illustrating the electrostatic photographic process according to the present invention, at the negative charging step (A), a photosensitive layer 1 on a substrate 2 is subjected to alternating current corona discharge or direct current negative corona discharge by a corona discharge electrode 3 to uniformly charge the photosensitive layer 1 negatively. At the subsequent positive charging step (B), this photosensitive layer 1 is subjected to direct current positive corona discharge by a corona discharge electrode 4, whereby the photosensitive layer 1 is uniformly charged positively according to the above-mentioned principle.

Then, the positively charged photosensitive layer 1 is exposed to actinic rays L at the imagewise exposure step (C). According to the above-mentioned principle, positive charges are caused to disappear in the exposed bright area 1-L by injection of electrons and neutralization by the injected electrons. On the other hand, in the non-exposed dark area 1-D, the positive charges are substantially left (practically, the potential is slightly reduced by the dark decay). Thus, the non-exposed area is positively charged and an uncharged electrostatic latent image is formed in the exposed area.

When the photosensitive layer 1 having the so formed electrostatic latent image is developed with a toner 6 having a high resistance at the developing step (D), a toner image corresponding to the electrostatic latent image is formed on the photosensitive layer 1. Any of toners having a volume resistivity of at least $10^{13}$ Ω-cm can be used. For example, either a one-component type magnetic toner or a two-component type toner may be used, so far at this requirement of the volume resistivity is satisfied. The latter toner ordinarily comprises a magnetic carrier or an insulating carrier such as glass beads. In order to form a positive image, a negatively chargeable toner is used as the toner 6, and in order to form a negative image, a positively chargeable toner is used as the toner 6. A known developing mechanism, for example, a magnetic brush developing mechanism, may be used as the developing mechanism 5 for applying the toner 6 to the photosensitive layer 1.

At the subsequent transfer step (E), the photosensitive layer 1 having the toner image 6 is superposed on a transfer sheet 7 and if necessary, the transfer sheet 7 is subjected from the back face thereof to positive corona discharge by a corona discharge electrode 8, whereby the toner image 6 on the photosensitive layer 1 is transferred onto the transfer sheet 7. The transfer sheet 7 having the toner image transferred thereon is separated from the photosensitive layer 1 and subjected to the fixing operation, and a copy having a fixed image 9 is obtained. This fixing operation (step F) is performed by known means such as heat fixation, pressure fixation or softening fixation using a solvent.

When the photographic process of the present invention is applied to reproduction of many copies from one original, that is, electrostatic photographic printing, at the cleaning step (G), the photosensitive layer 1 which has passed through the transfer step is cleaned by a cleaning mechanism 10 and is then subjected to positive charging at the step (B'). At this point, since ohmic contact is maintained in the interface between the zinc oxide particles and the binder in the exposed area 1-L of the photosensitive layer 1 as described in detail hereinbefore, charges given by positive corona discharge are neutralized by electrons and hence, charging is not effected. On the other hand, in the non-exposed area 1-D, since blocking contact is kept in the interface between the zinc oxide particles and the binder, charges given by positive corona discharge are not neutralized by electrons but these charges are retained, with the result that an electrostatic latent image is directly formed by the positive charging. When this photosensitive layer is passed through the above-mentioned developing and transfer steps (D) and (E), a copy is obtained.

As will readily be understood from the foregoing illustration, in the electrostatic photographic printing process according to the present invention, if the operations at the steps (A), (B), (C), (D) and (E) are first carried out and the operations at the steps (G), (B'), (D)

and (E) are then repeated necessary times, a predetermined number of copies can be obtained.

When the present invention is applied to ordinary electrostatic photographic reproduction where from many originals are formed corresponding copies, the photosensitive layer 1 which has passed through the transfer step (E) is entirely exposed to actinic rays L at the step (H), to maintain the above-mentioned ohmic contact in the interface between the zinc oxide particles and the binder throughout the photosensitive layer, whereby residual positive charges on the photosensitive layer are caused to disappear and the photosensitive layer is kept in the state where positive charging is impossible. The photosensitive layer 1 is then fed to the cleaning step (G') where the photosensitive layer 1 is subjected to the cleaning operation as mentioned above with respect to the cleaning step (G). Then, the operations are carried out at the steps (A), (B), (C), (D) and (E) in the same manner as described hereinbefore. As will be apparent from the foregoing illustration, in the electrostatic photographic reproduction process according to the present invention, when a series of the operations at the steps (A), (B), (C), (D), (E), (H) and (G') are conducted necessary times, copies are obtained.

In FIG. 1, the hatched portion of the photosensitive layer is an area where ohmic contact is maintained in the interface between the zinc oxide particles and the binder and positive charging is impossible. On the other hand, the blank portion is an area where blocking contact is maintained in the above-mentioned interface and positive charging is possible.

In the present invention, since a photosensitive layer having a reduced memory effect, such as described hereinbefore, is used, the photosensitive layer which has passed through the steps of exposure, development and transfer can be subjected to a series of operations of negative charging, positive charging and imagewise exposure directly without performing any particular operation for erasing the photomemory, for example, heating or standing. Accordingly, a characteristic effect of obtaining copies or prints through a short reproduction cycle by a very simple apparatus structure can be attained in the present invention.

As is shown in FIG. 2, at the step (E) of transferring the toner image, the dark area 1-D of the photosensitive layer 1 is positively charged through the transfer sheet 7. Accordingly, it must be understood that while the potential of this positive charging is at a level sufficient to effect development, this positive charging is effectively utilized and the positive charging step (B') can be omitted.

Figure 3:
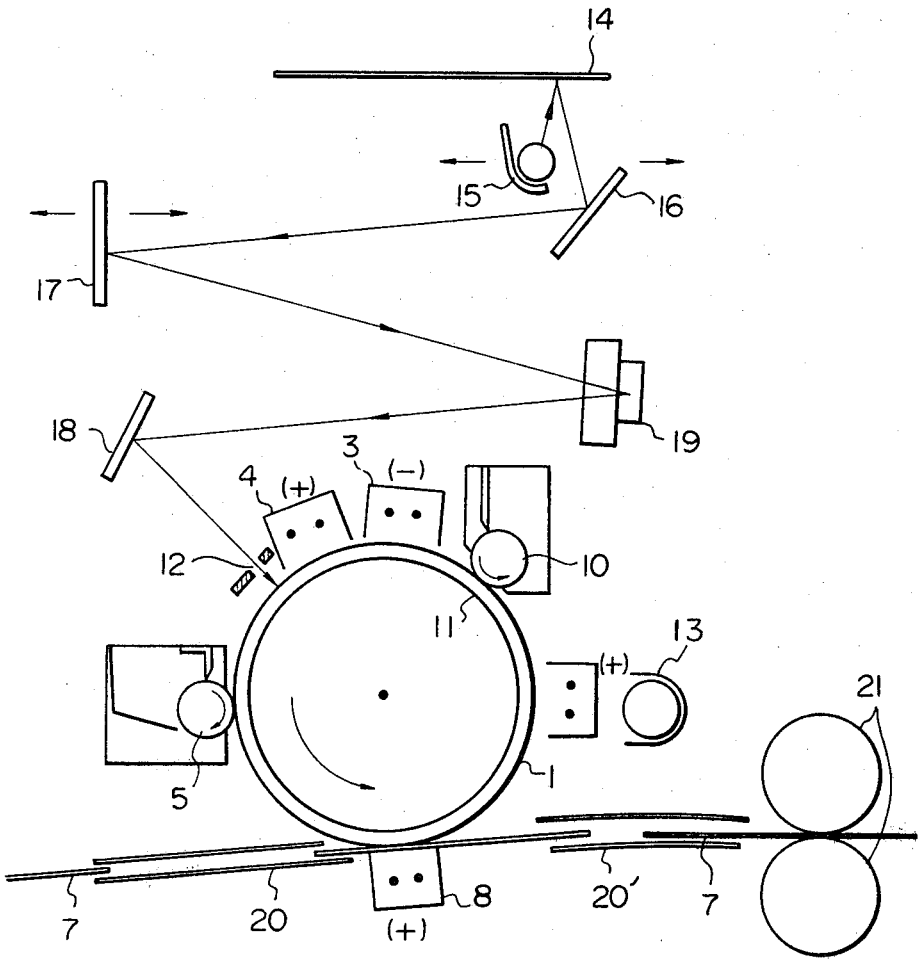
FIG. 3 is a diagram illustrating arrangement of respective mechanisms in a practical apparatus to which the photographic process of the present invention is applied.

Referring to FIG. 3 illustrating an embodiment where the present invention is applied to a practical copying machine, a negative corona discharge mechanism 3, a positive corona discharge mechanism 4, an exposure slit 12, a developing mechanism 5, a toner transfer positive corona discharge mechanism 8, an erasing mechanism 13 including a lamp optionally with a corona discharge mechanism and a cleaning device 10 are arranged in this order along the circumference of a driving drum 11 for supporting a photosensitive layer 1.

A light source 15, mirrors 16, 17 and 18 and an in-mirror lens 19 are disposed to project an image of an original 14 through the slit 12. The light source 15 and the mirrors 16 and 17 are scanned and driven at a speed synchronous with the speed of the drum 11, so that the original is scanned and projected through the slit 12 synchronously with the movement of the drum 11.

Furthermore, there are disposed a delivery passage 20 for supplying a copy sheet or printing paper 7 to the toner transfer region of the drum, that is, the position where the toner transfer positive corona discharge mechanism 8 is located, and another delivery passage 20' for supplying the copy sheet or printing paper 7 having the toner image transferred thereon to a fixing device 21.

At the time of copying or first printing (formation of a first print), the drum 11 is driven to subject the photosensitive layer 1 to removal of the electricity by the erasing mechanism 13 and also to cleaning by the cleaning device 10. Then, the photosensitive layer 1 is subjected to negative corona discharge by the discharge electrode 3 and positive corona discharge by the discharge electrode 4 in sequence. The original 14 is then exposed to rays from the light source 15 moving synchronously with the movement of the drum 11 and is projected on the photosensitive layer through the slit 12 by means of an optical system including the members 16, 17, 19 and 18.

A positive electrostatic latent image is thus formed on the photosensitive layer 1, and this latent image is developed by the developing mechanism 5. The toner image formed on the photosensitive layer is effectively transferred onto a transfer sheet 7 fed at a speed synchronous with the movement of the drum 11 with the aid of corona discharge by the discharge electrode 8. The sheet 7 having the transferred image is fed to the fixing device 21 and the toner image is fixed to obtain a copy or print.

For formation of second and subsequent prints, light exposure through the optical system, negative corona discharge by the discharge electrode 3 and removal of the electricity by the erasing mechanism 13 are stopped, but other mechanisms are operated in the same manner as described above. Thus, positive corona discharge, development and transfer are repeated necessary times, whereby a predetermined number of prints can easily be obtained. Since the operations for obtaining second and subsequent prints are very simple, the printing operation for obtaining second and subsequent prints can be conducted at a speed 10 to 40 times as high as the speed of the printing operation for obtaining the first print.

The present invention will now be described in detail with reference to the following Examples that by no means limit the scope of the invention.

EXAMPLE 1

The memory resistance (R) referred to in the present invention is a value defined by the following formula:

$$R = \frac{EL}{ED} \times 100$$

wherein ED stands for the saturation charge voltage (V) of the photosensitive layer observed when the photosensitive layer is stored in the dark for 3 hours and is then subjected to corona discharge at a voltage of $-6$ KV and EL stands for the saturation charge voltage (V) of the photosensitive layer observed when the photosensitive layer is irradiated with light in a light quantity of $3\times10^5$ lux·sec, stored in the dark for 1 minute and then subjected to corona discharge under the same conditions as described above.

The photosensitive material was allowed to stand still in the dark for 72 hours and was subjected to corona discharge at a voltage of $-6$ KV, and the saturation surface voltage ED was measured by a paper analyzer (manufactured by Kawaguchi Denki). This photosensitive material was first irradiated with rays in a light quantity of 5000 luxes for 60 seconds and allowed to stand in the dark for 60 seconds, and the photosensitive material was subjected to corona discharge at a voltage of −6 KV and the saturation surface voltage EL was measured by the above-mentioned paper analyzer. From the values of these saturation surface voltages, the memory resistance was calculated. We compared photosensitive materials having a memory resistance of at least 90% with photosensitive materials having a memory resistance lower than 90%.

When a photosensitive plate having a photosensitive layer having a memory resistance of at least 90% was used in the electrostatic photographic process of the present invention and the series of the steps of the photographic process were repeated a plurality of times, precise copies were obtained from originals. On the other hand, in case of a photosensitive material having a memory resistance lower than 90%, although many copies corresponding to a first original were obtained, when the original was exchanged with another original and the series of the steps of the photographic process were repeated, because of reduction of the saturation voltage (photomemory effect) in the light-exposed area, the density of the image in the black portion was reduced and an area of the black portion corresponding to the image of the first original was left blank and white.

More specifically, in case of a photosensitive material having a memory resistance lower than 90%, charging is not effected because of irradiation by an erasing lamp conducted in advance, with the result that an image is not formed.

In the above-mentioned photographic process, even if irradiation by the erasing lamp was not carried out to maintain the chargeable state, in case of the photosensitive material having a memory resistance lower than 90%, when the first orignial was exchanged with a second original and the photographic steps were repeated, the image area corresponding to the first original was not completely erased and there was caused an undesirable phenomenon where the image of the first original appeared also on an image of the second original. Therefore, it was confirmed that a photosensitive material having a memory resistance lower than 90% cannot be used for the photographic reproduction or printing process according to the present invention.

For the reasons set forth above, in all the experiments of the following Examples, photosensitive materials having a memory resistance of at least 90% were used.

A 40% by weight toluene solution of a styrene/butyl acrylate copolymer (manufactured by Nihon Junyaku, styrene/butyl acrylate ratio=2/1) (hereinafter referred to as "first resin") was mixed with a 70% by weight xylene solution of a silicone resin (KR-214 manufactured by Shinetsu Kagaku) (hereinafter referred to as "second resin") to form a resin binder in which the first resin/second resin weight ratio as the solids was 35/65.

The resin binder was coated on a support formed of an aluminum sheet by using a wire bar, and after the coating layer was sufficiently dried, the electric resistance was measured under normal conditions (a relative humidity of 65% and an ambient temperature of 20° C.). It was found that the electric resistance was $3.5\times10^{15}$ Ω-cm.

The resin binder was mixed with zinc oxide (fine product of Sazex manufactured by Sakai Kagaku, average particle size=0.43 μm, BET specific surface area=6.1 $m^2/g$) at a mixing weight ratio of 3/10 as the solids. Then, Rose Bengale and Rhodamine B were added to the above composition in amounts of 10 mg and 3 mg, respectively, per 10 g of zinc oxide. Then, toluene was added in an appropriate amount to adjust the viscosity and a silicone oil (KF-96, 10 CS manufactured by Shinetsu Kagaku,) was added in an amount of 0.03 mg per 10 g of zinc oxide. The mixture was sufficiently dispersed by an ultrasonic disperser to form a coating solution.

The so formed coating solution was coated on an aluminum foil having a thickness of 50 μm and was then naturally dried for 30 minutes. Then, the coating was dried at 100° C. for 30 minutes to obtain a photosensitive plate including a photosensitive layer having a dry thickness of 20 μm.

The so formed photosensitive plate was arranged on the peripheral surface of an earthed drum to form a photosensitive drum. The surface of the photosensitive drum rotated at a linear speed of 1.8 m/min was uniformly charged by a negative corona charging device to which a voltage of −6 KV was applied and was then uniformly charged by a positive corona charging device to which a voltage of +6 KV was applied. Then, according to the above-mentioned electrostatic photographic process of the present invention, the photosensitive drum was exposed to light according to an image of a first original to be reproduced, whereby a latent image of positive charges corresponding to the image of the original was formed on the surface of the photosensitive drum.

Then, the photosensitive drum having the positive charge latent image formed thereon was turned at a linear speed of 46 m/min and was charged by a positive corona charging device to which a voltage of 30 6 KV was applied. The positive charge latent image was developed with a toner consisting of a magnetic material and a resin and having a volume resistivity of $10^{14}$ Ω-cm and a particle size of 10 μm, which was supplied from a developing device. The formed toner image was transferred onto a transfer sheet by a corona discharge device to which a voltage of +6 KV was applied.

The transfer sheet having the toner image transferred thereon was passed through a fixing device and fed out of the fixing device as a first copy. On the other hand, the surface of the photosensitive drum which had passed through the transfer zone was cleaned by a cleaning device to remove the residual toner from the surface of the photosensitive drum. Then, the above photographic operations were repeated while the photosensitive drum was passed through the positive corona charging device, the developing device, the transfer device and the cleaning device repeatedly. Transfer sheets having a toner image transferred threon were correspondingly passed through the fixing device and discharged as copies from the fixing device. In this Example, when the copying operation was repeated about 200 times, it was found that the last copy was as clear as the first copy.

After about 200 copies had been obtained according to the above procedures, the photosensitive drum was exposed to 10,000 lux·sec of light to completely remove the residual toner. The photosensitive drum rotated at a linear speed of 1.8 m/min was uniforly charged again by the negative corona charging device to which a voltage of −6 KV was applied. Then, by imagewise exposure using a second original, a latent image of positive charges corresponding to an image of the second original was formed on the surface of the photosensitive drum. Then, the photosensitive drum having the positive charge latent image formed thereon was turned at a linear speed of 46 m/sec and was passed through the positive corona charging device, developing device, transfer device and cleaning device repeatedly, and the copying operation was thus repeated about 200 times. Many copies having an image as clear as the image of the first copy were obtained.

In this and subsequent Examples, the charging characteristics of photosensitive plates were determined in the following manner.

Figure 4:
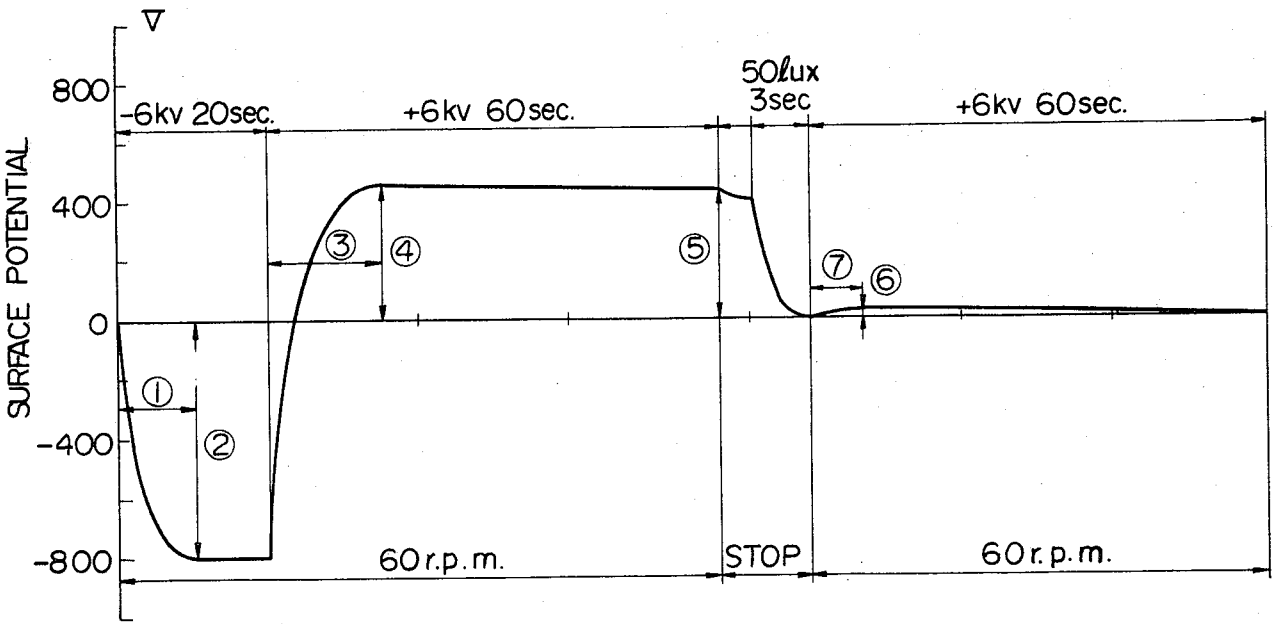
FIG. 4 is a graph illustrating the electrophotographic characteristics of the photosensitive layer according to the present invention.

The photosensitive plate was first subjected to preliminary exposure to light of 5000 luxes for 60 seconds and was immediately set at a paper analyzer. The plate was subjected to negative corona charging at a voltage of −6 KV for 20 seconds on a turn table rotated at 60 rpm (30 m/min), and the time required for the surface potential to arrive at the saturation voltage shown in FIG. 4 was measured [the value will be referred to as "value (1)" hereinafter]. The saturation voltage at this point was measured, but when the surface voltage did not arrive at the saturation voltage for 20 seconds, the voltage was measured after passage of 20 seconds from the point of initiation of the negative corona charging [the value will be referred to as "value (2)" hereinafter]. After completion of the above negative corona charging, positive corona charging was carried out at a voltage of +6 KV for 60 seconds, and the time required for the surface voltage to arrive at the saturation voltage was measured [this value was be referred to as "value (3)" hereinafter], and the saturation voltage at this point was measured [this value will be referred to as "value (4)" hereinafter]. The surface voltage obtained when the above positive corona charging was conducted for 60 seconds was measured [this value will be referred to as "value (5)" hereinafter]. After completion of the positive corona charging, the photosensitive plate was stopped at the exposure position and was exposed to light of 50 luxes for 3 seconds. Then, the photosensitive plate was subjected to positive corona charging again at a voltage of +6 KV on the turn table rotated at 60 rpm, and the saturation voltage was measured [this value will be referred to as "value (6)" hereinafter] and the time required for the surface voltage to arrive at this saturation voltage was measured [this value will be referred to as "value (7)" hereinafter].

The results of the measurements made on the photosensitive plate of this Example were as follows.

Value (1)=20 seconds, Value (2)=800 V, Value (3)=25 seconds, Value (4)=420 V, Value (5)=420 V, Value (6)=40 V, Value (7)=7 seconds

COMPARATIVE EXAMPLE 1

A photosensitive plate was prepared in the same manner as described in Example 1 except that the silicone oil (KF 96, 10 cSt) was not added. On this photosensitive plate, there were left row-like coating traces formed by the wire bar, and peeling of the photosensitive layer was caused in the end portion of the aluminum foil. Accordingly, this plate could not be practically used.

COMPARATIVE EXAMPLE 2

A photosensitive plate was prepared in the same manner as described in Example 1 except that the amount added of the silicone oil (KF96, 10 cSt) was changed to 0.01 mg per 10 g of ZnO. The copying operation was carried out in the same manner as described in Example 1 by using this photosensitive plate. The obtained image had a density lower than the density of the image obtained in Example 1.

The results of the measurements made on the above photosensitive plate were as follows.

Value (1)=20 seconds, Value (2)=560 V, Value (3)=11 seconds, Value (4)=250 V, Value (5)=200 V, Value (6)=0 V, Value (7)=-

COMPARATIVE EXAMPLE 3

A photosensitive plate was prepared in the same manner as described in Example 1 except that the amount added of the silicone oil (KF96, 10 cSt) was changed to 0.06 mg per 10 g of ZnO, and by using the so-obtained photosensitive plate, the copying operation was carried out in the same manner as described in Example 1. Clear images were obtained in the first to 10th copies, but in subsequent copies, fogging was caused in the light portion and the image quality was degraded.

The results of the measurements made on the above photosensitive plate were as follows.

Value (1)=15 seconds, Value (2)=840 V, Value (3)=30 seconds, Value (4)=460 V, Value (5)=460 V, Value (6)=90 V, Value (7)=25 seconds

COMPARATIVE EXAMPLE 4

A photosensitive plate was prepared in the same manner as described in Example 1 except that Rhodamine B was not added, and by using the so-prepared photosensitive plate, the copying operation was carried out in the same manner as described in Example 1. The image in the first copy was as clear as the image obtained in Example 1, but in the second and subsequent copies, fogging was caused in the light portion.

The results of the measurements made on the above photosensitive plate were as follows.

Value (1)=14 seconds, Value (2)=880 V, Value (3)=18 seconds, Value (4)=480 V, Value (5)=460 V, Value (6)=100 V, Value (7)=8 seconds

COMPARATIVE EXAMPLE 5

A photosensitive plate was prepared in the same manner as described in Example 1 except that the amount added of Rhodamine B was changed to 1.5 mg per 10 g of ZnO, and by using the so-prepared photosensitive plate, the copying operation was carried out in the same manner as described in Example 1. The first copy had a clear image, but in the second and subsequent copies, fogging was caused in the light portion.

The results of the measurements made on the above photosensitive plate were as follows.

Value (1)=20 seconds, Value (2)=850 V, Value (3)=20 seconds, Value (4)=450 V, Value (5)=430 V, Value (6)=80 V, Value (7)=7 seconds

COMPARATIVE EXAMPLE 6

A photosensitive plate was prepared in the same manner as described in Example 1 except that the amount added of Rhodamine B was changed to 6 mg per 10 g of ZnO. The memory resistance (R) of the obtained photosensitive plate was as low as about 50%. Therefore, this photosensitive plate could not be used in the present invention.

EXAMPLE 2

The copying operation was carried out in the same manner as described in Example 1 except that at the step of froming an electrostatic latent image of positive charge, the positive charging and light exposure were carried out simultaneously.

The obtained copies were as clear as the copies obtained in Example 1.

EXAMPLE 3

The copying operation was carried out in the same manner as described in Example 1 except that at the step of forming the photosensitive plate, the resin binder/zinc oxide weight ratio was changed to 4/10 and the dry thickness of the coating layer was changed to 17 μm.

The obtained copies were as clear as the copies obtained in Example 1, through the density of the dark area in the copies was slightly reduced.

The results of the measurements of the charging characteristics of the photosensitive plate were as follows.

Value (1)=20 seconds, Value (2)=670 V, Value (3)=50 seconds, Value (4)=210 V, Value (5)=210 V, Value (6)=0 V, Value (7)=-

EXAMPLE 4

The copying operation was carried out in the same manner as described in Example 1 except that at the step of forming the photosensitive plate, the resin binder/zinc oxide weight ratio was changed to 1/10 and the dry thickness of the coating was adjusted to 30 μm.

Unless imagewise exposure was carried out to a higher degree than in Example 1, fogs of the first copy did not disappear. When the copying operation was repeated in this state, the image density of the fifth and subsequent copies was much lower than the image density of the first copy.

The results of the measurements of the charging characteristics of the photosensitive plate were as follows.

Value (1)=7 seconds, Value (2)=1020 V, Value (3)=10 seconds, Value (4)=840 V, Value (5)=540 V, Value (6)=120 V, Value (7)=2 seconds

EXAMPLE 5

A photosensitive plate having a dry coating thickness of 20 μm was prepared in the same manner as described in Example 1 except that the mixing weight ratio of the first resin and the second resin as the solids was changed to 100/0 to form a resin binder having a volume resistivity of $9.3\times10^{13}$ Ω-cm. The copying operation was carried out by using this photosensitive plate in the same manner as described in Example 1.

The density of the image of the first copy was very low, and no image was formed in subsequent copies.

The results of the measurements of the charging characteristics of the photosensitive plate were as follows.

Value (1)=20 seconds, Value (2)=260 V, Value (3)=2 seconds, Value (4)=100 V, Value (5)=0 V, Value (6)=0 V, Value (7)=-

EXAMPLE 6

A photosensitive plate having a dry coating thickness of 11 μm was prepared in the same manner as described in Example 1 except that the mixing weight ratio of the first resin and the second resin as the solids was changed to 0/100 to form a resin binder having a volume resistivity of $4.6\times10^{16}$ Ω-cm. By using the so prepared photosensitive plate, the copying operation was carried out in the same manner as described in Example 1.

The obtained copies had an image as clear as in the copies obtained in Example 1.

The results of the measurements of the charging characteristics of the photosensitive plate were as follows.

Value (1)=20 seconds, Value (2)=630 V, Value (3)=30 seconds, Value (4)=260 V, Value (5)=260 V, Value (6)=20 V, Value (7)=10 seconds

EXAMPLE 7

A photosensitive plate having a dry coating thickness of 37 μm was prepared in the same manner as described in Example 6 except that the mixing weight ratio of the binder resin and zinc oxide was changed to 1/10. By using the so obtained photosensitive plate, the copying operation was carried out in the same manner as described in Example 6.

If the intensity of light exposure was increased, a first copy having a clear image of a high density was obtained, but the density of the dark area was gradually reduced in second and subsequent copies.

The results of the measurements on the charging characteristics of the photosensitive plate were as follows.

Value (1)=5 seconds, Value (2)=1060 V, Value (3)=9 seconds, Value (4)=1040 V, Value (5)=310 V, Value (6)=160 V, Value (7)=2 seconds

EXAMPLE 8

A photosensitive plate having a dry coating thickness of 21 μm was prepared in the same manner as described in Example 1 except that the weight ratio of the first resin and the second resin as the solids was adjusted to 50/50 to form a resin binder having a volume resistivity of $2.9\times10^{15}$ Ω-cm and the mixing weight ratio of the resin binder and zinc oxide was adjusted to 2/10. By using the so prepared photosensitive plate, the copying operation was carried out in the same manner as described in Example 1.

Obtained copies had an image as clear as in the copies obtained in Example 1.

The results of the measurements of the charging characteristics of the photosensitive plate were as follows.

Value (1)=14 seconds, Value (2)=850 V, Value (3)=12 seconds, Value (4)=450 V, Value (5)=410 V, Value (6)=30 V, Value (7)=2 seconds

EXAMPLE 9

A photosensitive plate having a dry coating thickness of 20 μm was prepared in the same manner as described in Example 1 except that the mixing weight ratio of the first resin and the second resin was changed to 97/3 to form a resin binder having a volume resistivity of $1.3\times10^{14}$ Ω-cam and the mixing weight ratio of the resin binder and zinc oxide was adjusted to 3/10. By using the so prepared photosensitive plate, the copying operation was carried out in the same manner as described in Example 1.

Copies having an image as clear as in the copies obtained in Example 1 were obtained.

The results of the measurements of the charging characteristics of the photosensitive plate were as follows.

Value (1)=20 seconds, Value (2)=700 V, Value (3)=20 seconds, Value (4)=270 V, Value (5)=250 V, Value (6)=15 V, Value (7)=5 seconds

EXAMPLE 10

A photosensitive plate having a dry coating thickness of 25 μm was prepared in the same manner as described in Example 9 except that the mixing weight ratio of the resin binder and zinc oxide was changed to 1/10. By using the so prepared photosensitive plate, the copying operation was carried out in the same manner as described in Example 9.

A clear image was formed on the first copy, but the image on the third and fourth copies was inferior because the density of the dark area was reduced and the contrast became indefinite between the dark area and the bright area. Therefore, the copying operation was not further carried out.

The results of the measurements of the charging characteristics of the photosensitive plate were as follows.

Value (1)=6 seconds, Value (2)=690 V, Value (3)=4 seconds, Value (4)=430 V, Value (5)=0 V, Value (6)=0 V, Value (7)=-

EXAMPLE 11

A photosensitive plate having a dry coating thickness of 24 μm was prepared in the same manner as described in Example 1 except that the mixing weight ratio of the first resin and the second resin as the solids was changed to 40/60 to form a resin binder having a volume resistivity of $3.2\times10^{15}$ Ω-cm and the mixing weight ratio of the resin binder and zinc oxide was adjusted to 3/10. By using the so prepared photosensitive plate, the copying operation was carried out in the same manner as described in Example 1.

Clear copied images were obtained and the obtained copies were not substantially different from the first copy in the image density and sharpness.

The results of the measurements of the charging characteristics of the photosensitive plate were as follows.

Value (1)=11 seconds, Value (2)=800 V, Value (3)=12 seconds, Value (4)=460 V, Value (5)=430 V, Value (6)=30 V, Value (7)=3 seconds

EXAMPLE 12

A photosensitive plate was prepared in the same manner as described in Example 11 except that zinc oxide Sox-500 (manufactured by Seido Kagaku, average particle size=0.72 μm, BET specific surface area=3.75 $m^2/g$) was used instead of the zinc oxide used in Example 11. By using the so prepared photosensitive plate, the copying operation was carried out in the same manner as described in Example 1.

Even in the first copy, the image density was low, and no image was formed in subsequent copies.

The results of the measurements of the charging characteristics of the photosensitive plate were as follows.

Value (1)=10 seconds, Value (2)=550 V, Value (3)=10 seconds, Value (4)=140 V, Value (5)=50 V, Value (6)=0 V, Value (7)=-

EXAMPLE 13

A photosensitive plate was prepared in the same manner as described in Example 11 except that zinc oxide Sazex (manufactured by Sakai Kagaku, average particle size=0.53 μm, BET specific surface area=4.6 $m^2/g$) was used instead of the zinc oxide used in Example 11. By using the so prepared photosensitive plate, the copying operation was carried out in the same manner as described in Example 1.

In the first through 50th copies, the image density was maintained at the same level, and occurrence of fogs as observed in Example 7 was not caused but the density of the dark area was relatively low.

The results of the measurements of the charging characteristics of the photosensitive plate were as follows.

Value (1)=15 seconds, Value (2)=690 V, Value (3)=15 seconds, Value (4)=170 V, Value (5)=160 V, Value (6)=0 V, Value (7)=-

EXAMPLE 14

A photosensitive plate having a dry coating thickness of 20 μm was prepared in the same manner as described in Example 1 except that the mixing weight ratio of the first resin and the second resin as the solids was changed to 78/22 to form a resin binder having a volume resistivity of $1.2\times10^{15}$ Ω-cm and the mixing weight ratio of the resin binder and zinc oxide was adjusted to 3/10. By using the so prepared photosensitive plate including an aluminum foil, the copying operation was carried out in the same manner as described in Example 1.

Copies having an image as clear as the image of the first copy were obtained.

The results of the measurements of the charging characteristics of the photosensitive plate were as follows.

Value (1)=8 seconds, Value (2)=750 V, Value (3)=10 seconds, Value (4)=350 V, Value (5)=340 V, Value (6)=18 V, Value (7)=30 seconds

EXAMPLE 15

A photosensitive plate was prepared in the same manner as described in Example 14 except that an electrically conductive paper was used as the support instead of the aluminum foil used in Example 14. By using the so prepared photosensitive plate, the copying operation was carried out in the same manner as described in Example 14.

Fogs were produced in the bright area, and only copies having an entirely black image were obtained.

The results of the measurements of the charging characteristics of the photosensitive plate were as follows.

Value (1)=20 seconds, Value (2)=630 V, Value (3)=40 seconds, Value (4)=630 V, Value (5)=630 V, Value (6)=630 V, Value (7)=60 seconds

EXAMPLE 16

A photosensitive plate was prepared in the same manner as described in Example 14 except that a copper sheet was used instead of the aluminum foil used in Example 14. The copying operation was carried out in the same manner as described in Example 14 by using the so prepared photosensitive plate.

No copied image was obtained because of fogs produced in the bright area.

The results of the measurements of the charging characteristics of the photosensitive plate were as follows.

Value (1)=9 seconds, Value (2)=750 V, Value (3)=60 seconds, Value (4)=500 V, Value (5)=500 V, Value (6)=300 V, Value (7)=60 seconds

EXAMPLE 17

A photosensitive plate was prepared in the same manner as described in Example 17 except that an undercoat resin (Fuji-Hec HEC-PC-L) was coated in a thickness of about 4 μm on the aluminum foil used in Example 14. The volume resistivity was $10^{10}$ Ω-cm. By using the so prepared photosensitive plate, the copying operation was carried out in the same manner as in Example 14.

No copied image was obtained because of fogs produced in the bright area.

The results of the measurements of the charging characteristics of the photosensitive plate were as follows.

Value (1)=15 seconds, Value (2)=630 V, Value (3)=20 seconds, Value (4)=680 V, Value (5)=680 V, Value (6)=680 V, Value (7)=20 seconds

EXAMPLE 18

A photosensitive plate having a dry coating thickness of 22 μm was prepared in the same manner as described in Example 11 except that the mixing weight ratio of the resin binder and zinc oxide was changed to 5/10. By using the so prepared photosensitive plate, the copying operation was carried out in the same manner as described in Example 1.

In the first copy, the image density of the dark area was low, and the density was gradually increased in the 20th through 30th copies and fogs in the bright area become simultaneously prominent. When the original was exchanged with another original after completion of the above copying operation and the copying operation was conducted again in the same manner, the density of the first copy was lower than the density in the first copy obtained by the preceding copying operation and in subsequent copies, the contrast between the bright area and the dark area become indefinite.

The results of the measurements of the charging characteristics of the photosensitive plate were as follows.

Value (1)=20 seconds, Value (2)=500 V, Value (3)=60 seconds, Value (4)=250 V, Value (5)=250 V, Value (6)=110 V, Value (7)=60 seconds

EXAMPLE 19

A photosensitive plate was prepared in the same manner as described in Example 1 except that Acrydic 7-1027 (manufactured by Dainippon Ink Kagaku Kogyo) was used as the resin binder and the mixing weight ratio of the resin binder and zinc oxide as the solids was adjusted to 2.5/10. The volume resistivity of the resin binder was $1.36\times10^{16}$ Ω-cm. The thickness of the photosensitive layer formed was 15 μm.

By using the so prepared photosensitive plate, the copying operation was carried out in the same manner as described in Example 1. In the first through 100th copies, the copied images were very clear. When the original was exchanged with another original and the copying operation was conducted again, 100 copies having a clear image not influenced by the image formed by the preceding copying operation were obtained.

The results of the measurements of the charging characteristics of the photosensitive plate were as follows.

Value (1)=15 seconds, Value (2)=700 V, Value (3)=15 seconds, Value (4)=290 V, Value (5)=240 V, Value (6)=0, Value (7)=-

EXAMPLE 20

A photosensitive plate having a dry coating thickness of 15 μm was prepared in the same manner as described in Example 19 except that Arotap 5000 (manufactured by Nippon Shokubai Kagaku Kogyo) was used instead of the resin used in Example 19. The volume resistivity of the resin used was $7.97\times10^{15}$ Ω-cm. By using the so prepared photosensitive plate, the copying operation was carried out in the same manner as described in Example 1 to obtain 200 clear copies. When the original was exchanged with another original and the copying operation was conducted again, 200 clear copies not influenced by the image formed by the preceding copying operation were obtained.

The results of the measurements of the charging characteristics of the photosensitive plate were as follows.

Value (1)=20 seconds, Value (2)=660 V, Value (3)=22 seconds, Value (4)=300 V, Value (5)=300 V, Value (6)=40 V, Value (7)=40 seconds

What we claim is:

1. in an electrostatic photographic process comprising subjecting an electrostatic photographic photosensitive plate to the combination of negative charging, positive charging and imagewise exposure to form an electrostatic latent image of a positive polarity, said electrostatic photographic photosensitive plate having such charging characteristics that (a) a photosensitive layer can be positively charged by sequential negative corona charging and positive corona charging and (b) positive charging is rendered substantially impossible by irradiation with light, and then subjecting the so treated photosensitive plate to positive charging a predetermined number of times, whereby an electrostatic latent image is formed the predetermined number of times by imagewise exposure conducted once, an improvement wherein said electrostatic photographic photosensitive plate comprises an electrically conductive substrate having a surface with a work function smaller than the work function of ZnO and being selected from the group consisting of aluminum, zinc, cadmium, lead, indium and tin and a photoconductive zinc oxide-resin binder dispersion photosensitive layer comprising a dispersion of photoconductive zinc oxide having a particle size not larger than 0.53 μm and a BET specific surface area of at least 4.6 $m^2/g$ and a resin binder having a volume resistivity of at least $10^{14}$ Ω-cm, in which the resin binder/zinc oxide mixing weight ratio is larger than 1/10 and smaller than 5/10, said photoconductive layer further comprising a triphenylmethane basic dyestuff represented by the following formula:

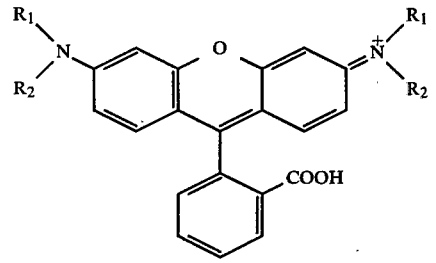

wherein $R_1$ represents a lower alkyl group and $R_2$ represents a hydrogen atom or a lower alkyl group, in an amount of about 2 to about 3 mg per 10 g of zinc oxide and a silicone oil in an amount of about 0.02 to about 0.04 mg per 10 g of zinc oxide, and said photosensitive plate has a memory resistance (R), defined by the following formula, of at least 90%:

$$R = \frac{EL}{ED} \times 100$$

wherein ED stands for the saturation charge voltage (V) of the photosensitive layer observed when the photosensitive layer is stored in the dark for 3 hours and is then subjected to corona discharge at a voltage of −6 KV and EL stands for the saturation charge voltage (V) of the photosensitive layer observed when the photosensitive layer is irradiated with light in a light quantity of $3\times10^5$ lux.sec, stored in the dark for 1 minute and then subjected to corona discharge under the same conditions as described above.

2. An electrostatic photographic process according to claim 1, wherein the resin binder/zinc oxide mixing weight ratio is in the range of from 2/10 to 4/10.

3. An electrostatic photographic process according to claim 1 or 2, wherein the photoconductive zinc oxide has a particle size smaller than 0.5 μm and a BET specific surface area of at least 5 $m^2/g$.

4. An electrostatic photographic process according to claim 1, wherein the negative charging of the photosensitive layer is carried out by subjecting the photosensitive layer by alternating current corona discharge or direct current negative corona discharge.

5. An electrostatic photographic process according to claim 1, wherein the positive charging of the photosensitive layer is carried out by subjecting the photosensitive layer to direct current positive corona discharge.

6. An electrostatic photographic process according to claim 1, wherein the photosensitive layer is subjected to alternating current corona discharge or direct current negative corona discharge to uniformly charge the photosensitive layer negatively, the so charged photosensitive layer is subjected to direct current positive corona discharge to uniformly charge the photosensitive layer positively, and the so positively charged photosensitive material is subjected to imagewise exposure to form an electrostatic latent image in which the non-exposed area is positively charged and the exposed area is not substantially charged.

7. An electrostatic photographic reproduction process in which an electrostatic latent image formed according to the electrostatic photographic process set forth in claim 6 is developed with a toner having an electric resistance of at least $10^{13}$ Ω-cm and the toner image formed on the photosensitive layer is transferred onto a transfer sheet and is then fixed.

8. An electrostatic photographic process for printing according to claim 7 in which after the transfer step of the electrostatic photographic process, the photosensitive layer is subjected to direct current positive corona discharge to form an electrostatic latent image in which the non-exposed area is not substantially charged, the so formed electrostatic latent image is developed with a toner having an electric resistance of at least $10^{13}$ Ω-cm, the toner image formed on the photosensitive layer is transferred to a print paper and is then fixed, and the series of said steps are conducted a predetermined number of times.

9. An electrostatic photographic process for reproduction according to claim 6 or claim 7 in which the steps are conducted a predetermined number of times on one photosensitive layer.

10. An electrostatic photographic process according to claim 1, wherein said triphenylmethane basic dye is C.I. Basic Violet 10.

11. An electrostatic photographic process according to claim 1 wherein the resin binder/zinc oxide mixing weight ratio is in the range of from 2.5/10 to 3.5/10.

12. An electrostatic photographic process according to claim 1 wherein the silicone oil is a linear polydimethylsiloxane having a viscosity of 5 to 50 cSt as measured at 25° C.

13. The electrostic photographic process according to claim 1 wherein the photoconductive zinc oxide-resin binder dispersion photosensitive layer has a thickness in the range of from 3 to 50 microns, as measured in the dry state.

* * * * *